United States Patent [19]

Bidegain

[11] 3,987,894

[45] Oct. 26, 1976

[54] PRESENTATION CASKET

[75] Inventor: Georgy Bidegain, Pau (Pyrenees Atlantiques), France

[73] Assignee: E M B A D A C, Morlaas (Pyrenees Atlantiques), France

[22] Filed: Mar. 19, 1975

[21] Appl. No.: 559,711

[30] Foreign Application Priority Data

Apr. 12, 1974 France ..... 74.12913

[52] U.S. Cl. ..... 206/45.15; 206/45.19

[51] Int. Cl.[2] ..... B65D 5/50

[58] Field of Search. 206/44 R, 45.11, 45.14–45.19, 206/74–76, 491; 248/152, 415, 174; 312/71

[56] References Cited

UNITED STATES PATENTS

| | | | |
|---|---|---|---|
| 850,182 | 4/1907 | Poor | 206/45.11 UX |
| 1,494,361 | 5/1924 | Lambert | 206/45.18 |
| 1,666,001 | 4/1928 | Catala | 206/45.18 UX |
| 1,726,732 | 9/1929 | Doran | 206/45.15 X |
| 1,811,164 | 6/1931 | Wilson | 206/45.18 X |

*Primary Examiner*—Steven E. Lipman
*Attorney, Agent, or Firm*—Young & Thompson

[57] ABSTRACT

The invention relates to a presentation casket made especially of sheet material such as cardboard, wood, metal, plastic or the like, and designed to contain and display an appropriate article such as a bottle of perfume, a jewel, etc. The casket is of simple construction on manual or automatic machines; it has a low production cost but is of elegant appearance. The casket comprises a casing formed by two shells pivoted one on the other on a rear vertical axis so as to be capable of opening from the front from a position of closure, a base in the bottom inside of the casing receiving the article to be presented and being joined to the shells by elastic coupling means such as bellows members arranged so as to apply a thrust against the base, symmetrically with respect to the shells. It is thus easy to manipulate the casket between the closed position in which the article is firmly held in place and protected inside the casket, and one or more opening positions in which the article is displayed in its entirety with an excellent presentation.

5 Claims, 11 Drawing Figures

PRESENTATION CASKET

The present invention has for its object a presentation casket constituted especially by sheet material such as cardboard, wood, metal, plastic or the like, and intended to contain and to display any appropriate article, for example a bottle of scent, a jewel or the like, this casket being of very simple construction on automatic or manual machines, and inexpensive but at the same time elegant and easy to manipulate between a closed position in which the article is effectively protected in the casket, and one or more open positions in which the article is wholly visible with an excellent presentation.

According to the invention, a presentation casket is characterized in that it comprises a casing composed of two shells pivoted one on the other along a rear vertical axis, for example by means of a vertical hinge of paper, canvas or the like, interior and exterior, so as to be capable of opening at the front from a position of closure, a base arranged in the interior at the bottom of the casing and intended to receive an article to be presented, an elastic coupling means connecting the base to the shells and intended to apply a thrust against the base in a symmetrical manner with respect to the shells.

By virtue of this arrangement, the casket conveniently carries out the double function of containing the article and of presenting it wholly. It will be appreciated that between the closed position and a more or less accentuated open position or vice-versa, the elastic coupling means enable irreprochable operation to be obtained.

According to another characteristic feature, the elastic coupling means are arranged inside the casing behind the base and are formed by two bellows members extended by means for fixing to the base and to the casing.

The two bellows and their fixing means are preferably constituted by a folded flap having a central portion fixed to the base, two free intermediate portions respectively forming the two bellows members, and two end portions respectively fixed on the two shells.

According to a further characteristic feature, the central portion of the flap is permitted, during a movement of the shells towards the closed position, to move forward at the top, which helps to hold the article firmly in the closed casket.

Forms of embodiment of the invention are described below by way of example, reference being made to the accompanying drawings, in which.

Reference will first be made to FIGS. 1 to 9, which are concerned by way of example with an application of the invention to a presentation casket of generally parallelepiped form for an article A to be presented, such as a bottle of perfume or the like. The presentation casket comprises a casing indicated generally at 10 and composed of two shells 11 and 12 constituted by hollow parallelepiped boxes.

The shells 11 and 12 are articulated on each other along a rear vertical axis 13 constituted by a hinge which is obtained by means of an outer sheet 14 and an inner sheet 15 respectively glued on the shells 11 and 12.

Figure 1:
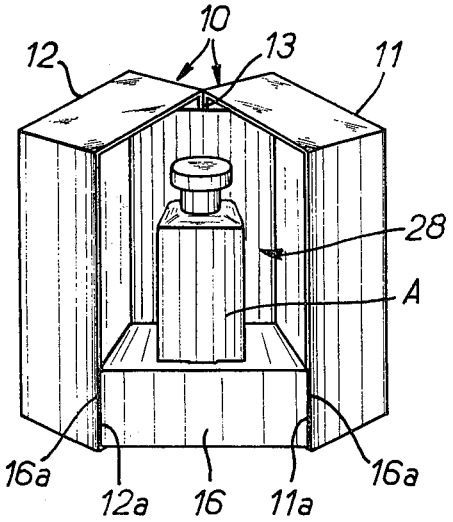
FIG. 1 is a perspective view of a presentation casket according to the invention, in the normal position of opening for presentation.
Figure 5:
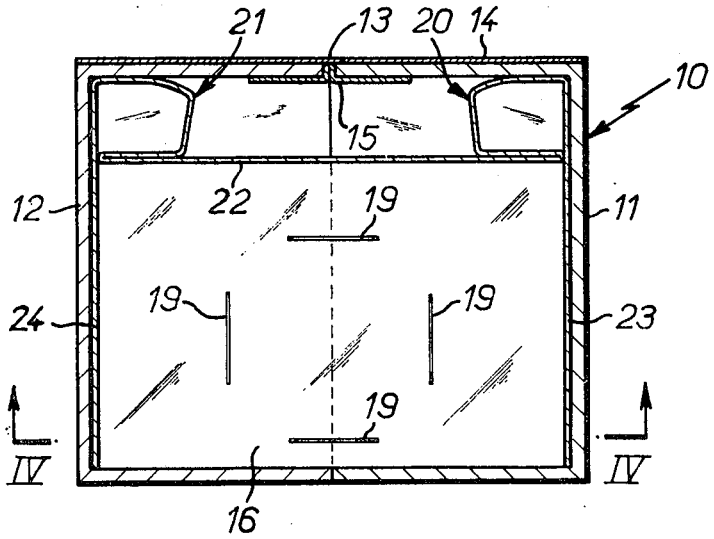
FIGS. 5 and 6 are views of the casket of FIG. 4 in horizontal sections taken respectively along the line V—V and the line VI—VI of FIG. 4.
Figure 6:
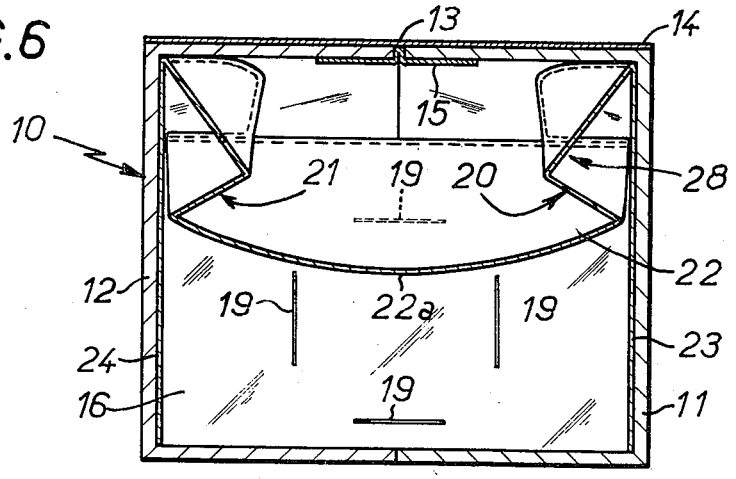
Figure 7:
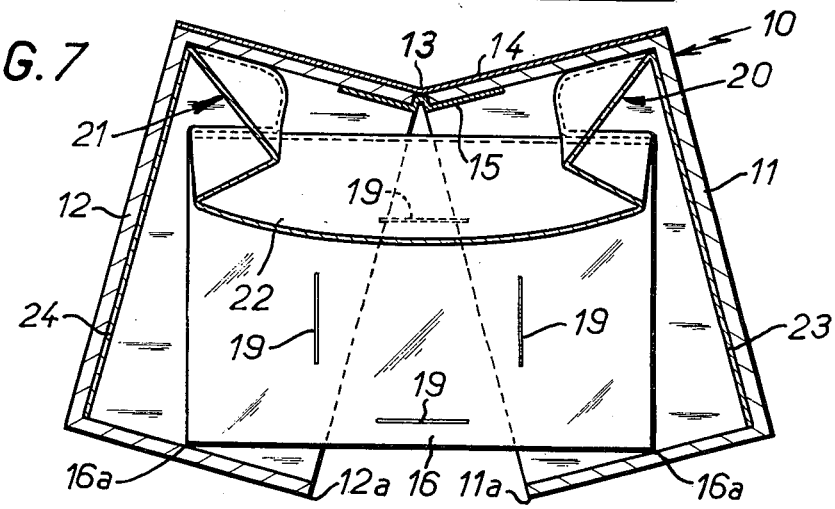
FIGS. 7 and 8 are views similar to that of FIG. 6, but show the casket respectively in the half-open position and in the fully-open position.
Figure 8:
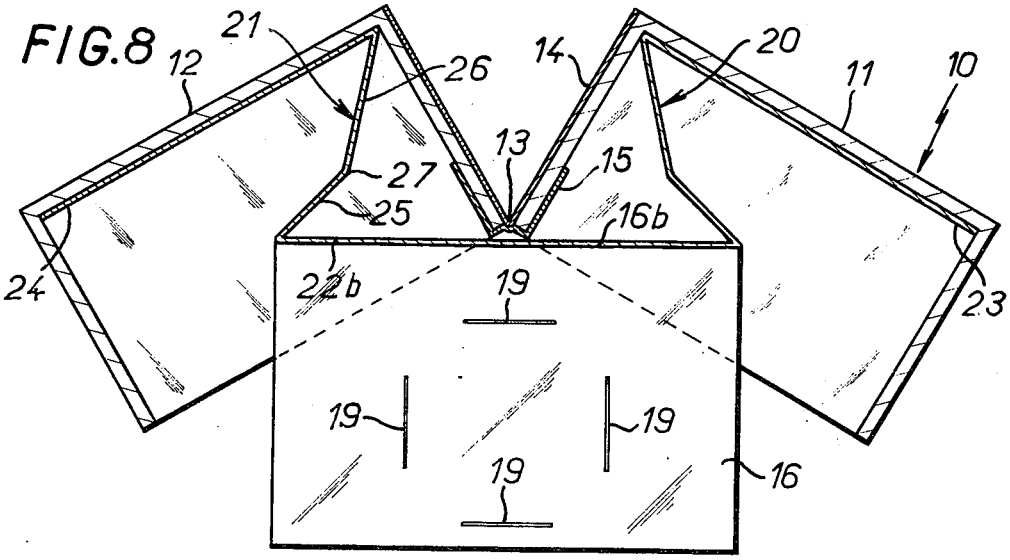

The two shells 11 and 12 thus articulated at 13 can be opened from the front (see FIGS. 1, 7 and 8) from a closed position shown in FIGS. 5 and 6. The position of opening of FIG. 7 is a position of partial opening or half-opening. That of FIG. 1 is a position of normal opening for presentation; and that of FIG. 8 is the position of maximum opening.

A base 16 of parallelepiped shape is arranged in the interior and at the bottom of the casing 10, and is intended to receive the article A to be presented.

Figure 4:
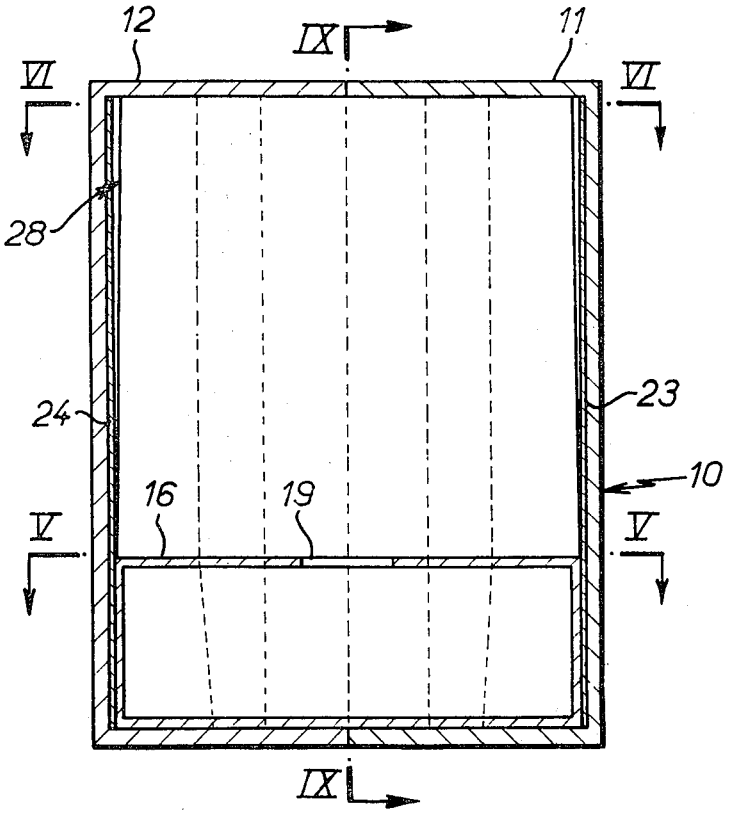
FIG. 4 is a view of the casket in the closed position, in front section taken along the line IV—IV of FIG. 5.
Figure 9:
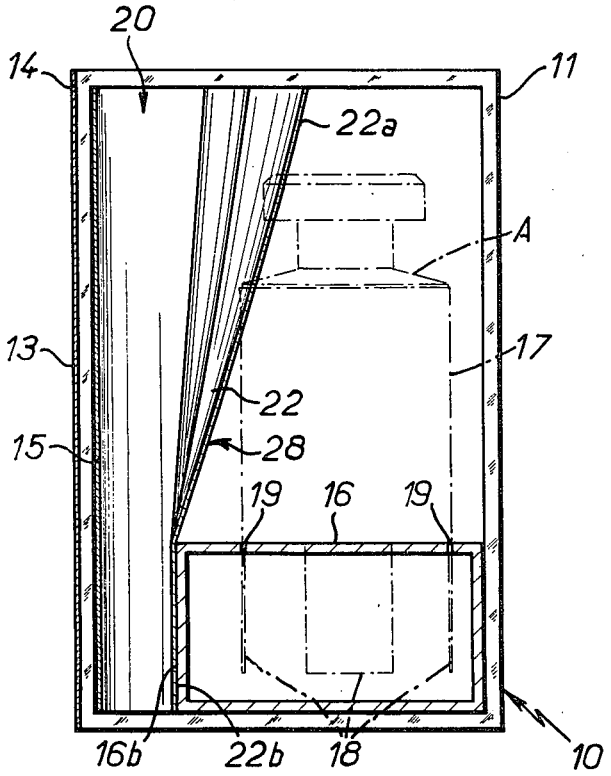
FIG. 9 is a view of the casket of FIG. 4 in lateral section taken along the line IX—IX of FIG. 4.

To this end, there is provided a socket 17 of transparent material (see FIG. 3) having lower lugs 18 intended to be engaged in slots 19 in the base 16 (see FIGS. 4, 5 and 9). The transparent socket 17 thus firmly fixed to the base 16 is intended to receive by engagement by the top and to enclose the article A such as a bottle, by holding it rigidly in position on this base.

Elastic coupling means 20 and 21 connect the base 16 to the shelves 11 and 12 and are intended to apply a horizontal forward thrust on the base 16 in a symmetrical manner with respect to the shelves 11 and 12.

Figure 2:
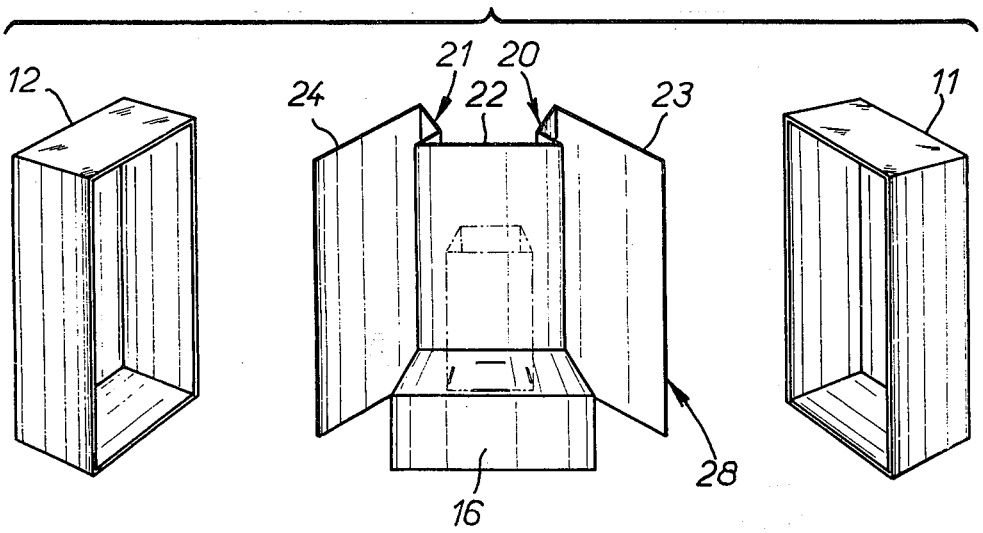
FIG. 2 is a view similar to FIG. 1 but exploded so as to show the two shells and the base provided with the flap.
Figure 3:
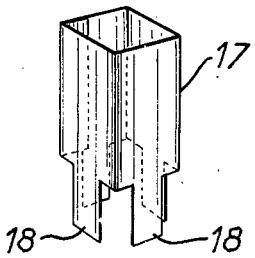
FIG. 3 shows a perspective view of a socket fixable on the base so as to hold the article in position on the said base.

The elastic coupling means 20 and 21 are arranged inside the casing 10 to the rear of the base 16, and are formed as shown in FIG. 2 by two bellows members 20 and 21 extended by means 22 for fixing to the base 16, by means 23 for fixing to the shell 11 and by means 24 for fixing to the shell 12.

In the example shown, each bellows 20 and 21 comprises (see FIG. 8) two elements 25 and 26 separated by a vertical fold 27. It is more particularly seen in FIG. 8 that the element 25 adjacent to the base 16 is narrower than the element 26 adjacent to the casing 10.

In the form of construction shown, the two bellows 20 and 21 and their fixing means 22, 23 and 24 are generally constituted by a folded flap 28 extending over the entire height of the casing 10.

The flap 28 has a central portion 22 fixed at the bottom to the base 16, two free intermediate portions 20 and 21 respectively forming the two bellows, and its two end portions 23 and 24 respectively fixed to the two shells 11 and 12.

It will be appreciated that the portions 23 and 24 exactly overlap the bottom of the shells 11 and 12.

In the form of construction shown, the shells 11 and 12, the base 16 and the elastic coupling means constituted by the flap 28 are formed by a material in sheets such as cardboard which can be fixed by glueing. More particularly, the central portion 22 of the flap 28 is glued at the bottom at **22*b*(see FIG. 9), uniformly or locally over the entire rear face 16*b* of the base 16, while the end portions 23 and 24 of the flap 28, which entirely overlap the bottoms of the shells 11 and 12**, are glued uniformly or locally on the said bottoms.

It will be appreciated that the construction which has just been described may be carried out either manually or entirely on an automatic cardboard packaging machine which permits the production cost to be reduced.

It will be noted more particularly from FIGS. 5 and 6 that the base 16 is arranged in such manner that in the closed position of the shells 11 and 12, it exactly fills a front portion of the horizontal section of the internal volume of the casing 10, and that it receives from the flap 28 a pressure sufficient to maintain the casket closed in its position of closure.

In this position of closure (see FIGS. 6 and 9), the central portion 22 of the flap 28 is permitted to move forward at the top at 22*a*, which assists in holding the article A fixed in the closed casket.

In order to open the casket, the shells 11 and 12 are caused to pivot about the hinge axis 13 (see FIG. 7), the front edges 16*a* of the base 16 constantly pressing against the shells 11 and 12 while maintaining the base 16 symmetrically under the elastic thrust of the bellows 20 and 21.

The casket is placed in the normal opening position for presentation, preferably when the two edges 16*a* coincide respectively with the edges 11*a* and 12*a* of the shells 11 and 12 (see FIG. 1).

The casket can be opened beyond this normal presentation opening up to the maximum opening position shown in FIG. 8, in which the base 16 comes into abutment at the rear against the hinge 13. In this position of maximum opening, the article A can be removed or placed in position without difficulty.

It will be appreciated that during the course of the movement of the shells 11 and 12 as they return towards the position of closure, the top 22*a* of the central portion 22 of the flap 28, which is first of all vertically aligned with the rear face 16*b* of the base 16

(see FIG. 8), moves forward gradually up to the position of closure in which it helps in holding the article A firmly, as shown in FIG. 9.

Figure 10:
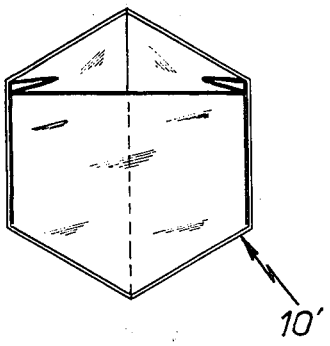
FIGS. 10 and 11 are diagrammatic views similar to FIG. 6 but relate respectively to two examples of possible alternative forms of the external casing.
Figure 11:
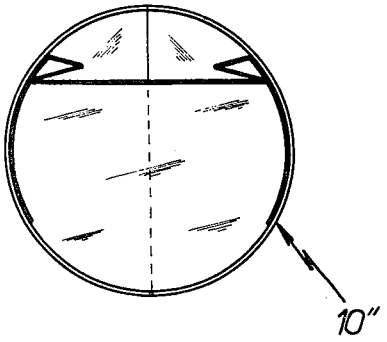

In the form of embodiment which has been described with reference to FIGS. 1 to 9, the casket has a rectangular section with parallelepiped elements, but it may also be given any other appropriate shape, for example a hexagonal shape as shown at 10' in FIG. 10 or a circular shape as shown at 10'' in FIG. 11.

What I claim is:

1. A presentation casket comprising a casing formed by two shells articulated on each other along a rear vertical axis so as to be adapted to open at the front from a closed position, a base disposed in the interior and at the bottom of said casing and adapted to receive an article to be presented, a folded flap having a central portion fixed to said base and having two end portions fixed respectively to the two shells and having two free intermediate portions forming respectively two bellows members elastically coupling the base to the shells to apply a thrust against the base in a symmetrical manner with respect to the shells.

2. A presentation casket as claimed in claim 1, in which each bellows member comprises two elements separated by a vertical fold.

3. A presentation casket as claimed in claim 1, in which, in the position of closure of said shells, the base fills exactly a front portion of the horizontal section of the internal volume of said casing.

4. A presentation casket as claimed in claim 1, in which said central portion of the flap moves forward at its top upon displacement of said shells towards the position of closure.

5. A presentation casket as claimed in claim 4, in which the forward movement of said flap and said bellows enables the article contained to be fixed in position when said casket is in the closed position.

* * * * *